US007900549B2

(12) United States Patent
Kobayashi

(10) Patent No.: US 7,900,549 B2
(45) Date of Patent: Mar. 8, 2011

(54) CUSHION RING AND FLUID-PRESSURE CYLINDER

(75) Inventor: Nobuyuki Kobayashi, Nagano (JP)

(73) Assignees: Kayaba Industry Co, Ltd, Tokyo (JP); Yanagisawa Seiki Mfg. Co., Ltd, Hanishina-Gun (JP)

( * ) Notice: Subject to any disclaimer, the term of this patent is extended or adjusted under 35 U.S.C. 154(b) by 492 days.

(21) Appl. No.: 12/116,964

(22) Filed: May 8, 2008

(65) Prior Publication Data

US 2008/0289486 A1 Nov. 27, 2008

(30) Foreign Application Priority Data

May 22, 2007 (JP) ..... 2007-135251

(51) Int. Cl.
*F15B 15/00* (2006.01)
*F15B 15/22* (2006.01)

(52) U.S. Cl. ..... 91/394; 91/405; 92/85 R

(58) Field of Classification Search ..... 91/394, 91/395, 396, 404, 405; 92/85 R, 143
See application file for complete search history.

(56) References Cited

U.S. PATENT DOCUMENTS 3,704,650 A * 12/1972 Berg ..... 91/395
4,296,675 A * 10/1981 Gies ..... 91/396
4,424,737 A * 1/1984 Endo ..... 91/396
6,523,452 B2 * 2/2003 Dougami ..... 91/394

FOREIGN PATENT DOCUMENTS

JP 2002-031106 A 1/2002

* cited by examiner

*Primary Examiner* — Thomas E Lazo
(74) *Attorney, Agent, or Firm* — Hiroe & Associates; Taras P. Bemko

(57) ABSTRACT

A cushion ring which is used between a rod-side cylinder head and a piston rod of a fluid-pressure cylinder and which is externally fitted on the piston rod to cushion a shock in the vicinity of the farthest extended end of cylinder includes a throttling groove that has a V-shaped cross section. The throttling groove extends from an appropriate position of the cushion ring to a rod-side end part and functions to throttle the flow of a working fluid flowing from a rod-side fluid chamber to an input/output port provided in a rod-side cylinder head. The throttling groove is provided at the outer periphery of the cushion ring. The throttling groove terminates at a rod-side end part with an end guide face that guides the working fluid toward a slantwise outward direction of the cushion ring.

2 Claims, 3 Drawing Sheets

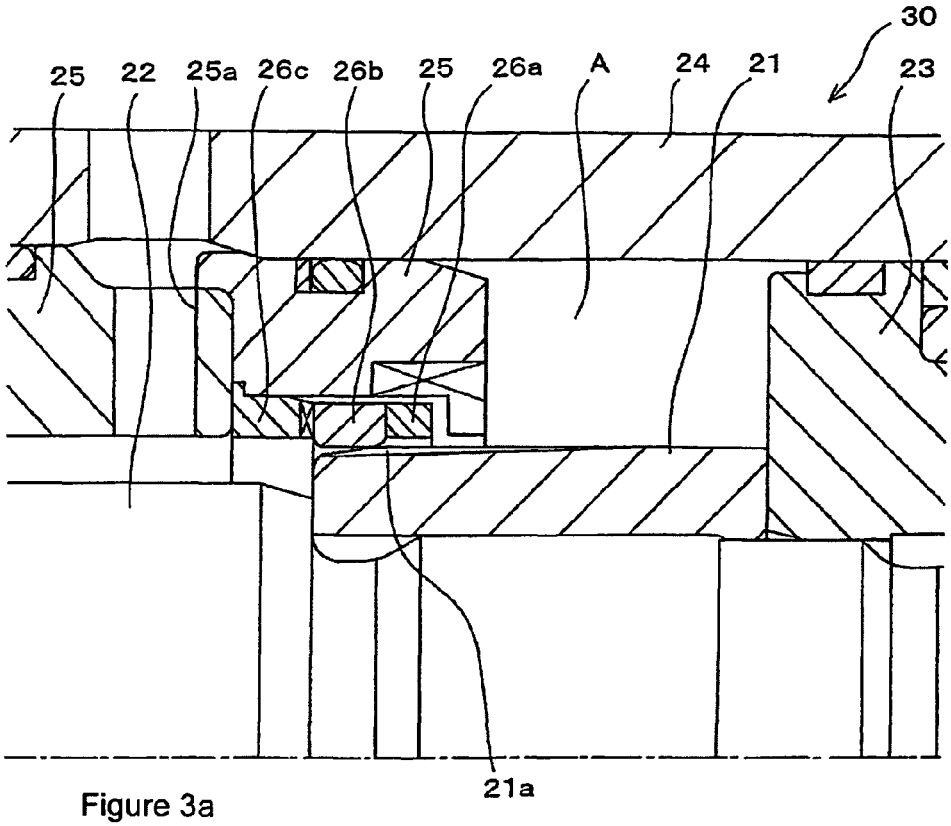
Figure 3a
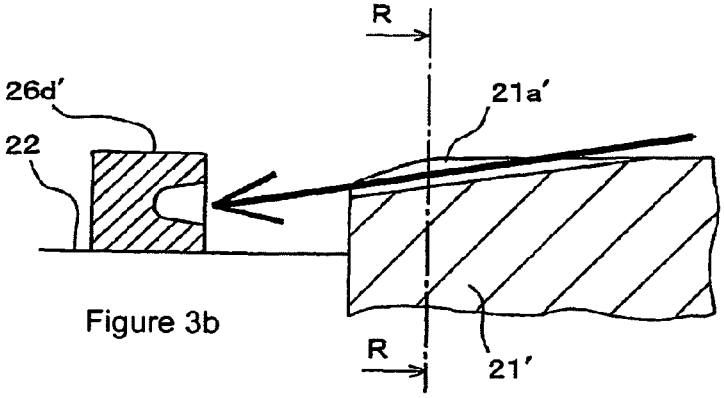
Figure 3b
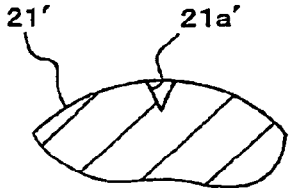
Fiugre 3c

CUSHION RING AND FLUID-PRESSURE CYLINDER

BACKGROUND OF THE INVENTION

The present invention relates to a cushion ring that is used between a rod-side cylinder head and a piston rod of a fluid-pressure cylinder and is externally fitted on the piston rod to cushion a shock in the vicinity of the farthest extended end of cylinder, and a fluid-pressure cylinder provided with this cushion ring.

Of fluid-pressure cylinders using an oil pressure, a water pressure, and the like, a fluid-pressure cylinder in which a working fluid is supplied to both the bottom side and the rod side of piston to generate a linear driving force uses a cushion ring to cushion a shock produced when the working fluid is supplied to the bottom side and thereby a piston rod extends and the piston comes into contact with a rod-side cylinder head, that is, a shock in the vicinity of the farthest extended end of cylinder.

One example of the fluid-pressure cylinder using such a cushion ring is explained with reference to FIGS. 3*a*-3*c*. FIG. 3*a* is a longitudinal sectional view typically showing the fluid-pressure cylinder using a cushion ring that is the related art of the present invention, FIG. 3*b* is an explanatory view for explaining the operation of the cushion ring in the case where a throttling groove of the cushion ring shown in FIG. 3*a* has a V-shaped cross section, and FIG. 3*c* is a sectional view taken along the line R-R of FIG. 3*b*.

A fluid-pressure cylinder 30 shown in FIG. 3*a*, which is described in Japanese Unexamined Patent Application Publication No. 2002-31106, includes a piston rod 22 externally fitted with a cushion ring 21, a piston 23 provided in the base end part of the piston rod 22, a cylinder body 24 for sliding the piston 23 therein, and a rod-side cylinder head 25 that seals the rod side of the cylinder body 24.

The cushion ring 21 is externally fitted in a reduced-diameter part of the piston rod 22. To this reduced-diameter part, the piston 23 is further fixed in an externally fitted manner. The cushion ring 21 slides together with the piston 23 and the piston rod 22 while being restrained by the piston 23.

At the outer periphery of the cushion ring 21, a slit 21*a* extending from an appropriate position in the axial length of the cushion ring 21 to a rod-side end part is provided, so that the cushion ring 21 cushions a shock in the vicinity of the farthest extended end of cylinder by throttling the flow quantity of working fluid flowing from a rod-side fluid chamber A to an input/output port 25*a* provided in the rod-side cylinder head 25.

In relation to this throttling operation, on the inside diameter side of the rod-side cylinder head 25, on which the cushion ring 21 is fitted in, a spacer 26*a*, a cushion seal 26*b*, and a collar 26*c* are provided in the named order from the bottom side.

For the fluid-pressure cylinder 30, the spacer 26*a* can move in the axial direction, and the inside diameter of the spacer 26*a* is larger than the inside diameter of the cushion seal 26*b*, by which vibrations of the cushion seal 26*b* are suppressed, and thereby noise is prevented from being produced by the vibrations (paragraph [0031] of Japanese Unexamined Patent Application Publication No. 2002-31106).

On the other hand, the slit 21*a* at the outer periphery of the cushion ring 21 functions as a throttling groove for working fluid to cushion a shock. Depending on the application, this groove may be made a throttling groove 21*a*' having a V-shaped cross section as in a cushion ring 21' shown in FIGS. 3*b* and 3*c*.

If such a throttling groove 21*a*' having a V-shaped cross section is provided, as shown in FIG. 3*b*, when the cushion ring 21' enters into the rod-side cylinder head 25 in the vicinity of the farthest extended end of the cylinder, a jet stream throttled by the throttling groove 21*a*' collides with a U-packing 26*d*' on the rod side, so that the U-packing 26*d*' may be damaged. Therefore, improvement has been desired.

SUMMARY OF THE INVENTION

The present invention has been made to solve the above problem, and accordingly an object thereof is to provide a cushion ring having no possibility of damage to a U-packing on the rod side even in the case where a throttling groove having a V-shaped cross section is provided, and to provide a fluid-pressure cylinder using the cushion ring.

BRIEF DESCRIPTION OF THE DRAWINGS

FIG. 3*a* is a longitudinal sectional view illustrating a fluid-pressure cylinder using a cushion ring that is the related art of the present invention, FIG. 3*b* is an explanatory view for explaining the operation of the cushion ring in the case where a throttling groove of cushion ring has a V-shaped cross section, and FIG. 3*c* is a sectional view taken along the line R-R of FIG. 3*b*.

DETAILED DESCRIPTION OF THE PREFERRED EMBODIMENT

An embodiment (example) of the present invention will now be described with reference to the accompanying drawings.

Figure 1A:
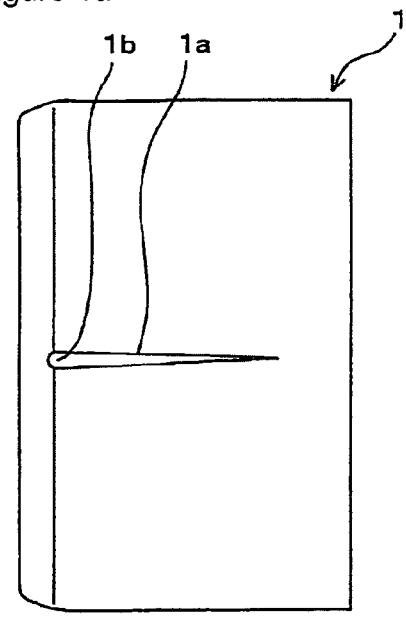
FIG. 1*a* is a top view showing one example of a cushion ring in accordance with the present invention.
Figure 1D:
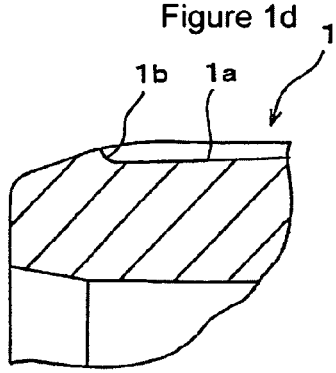
FIG. 1*d* is an enlarged view of a portion indicated by N in FIG. 1*b*.
Figure 1E:
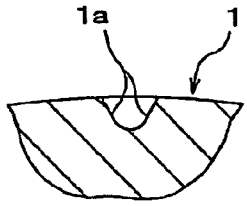
FIG. 1*e* is an enlarged view of a portion indicated by P in FIG. 1*c;*
Figure 1B:
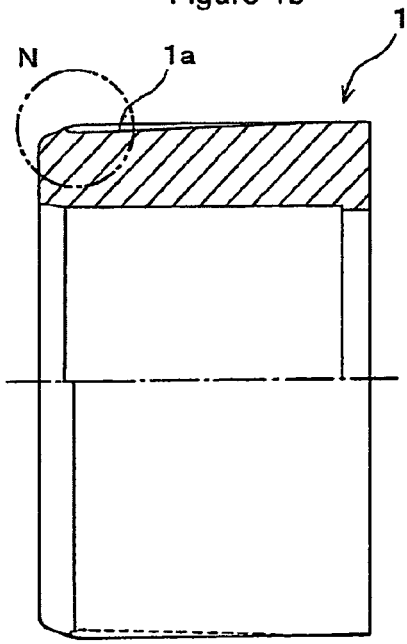
FIG. 1*b* is a side view of the cushion ring shown in FIG. 1*a*, in which the upper half thereof is sectioned.
Figure 1C:
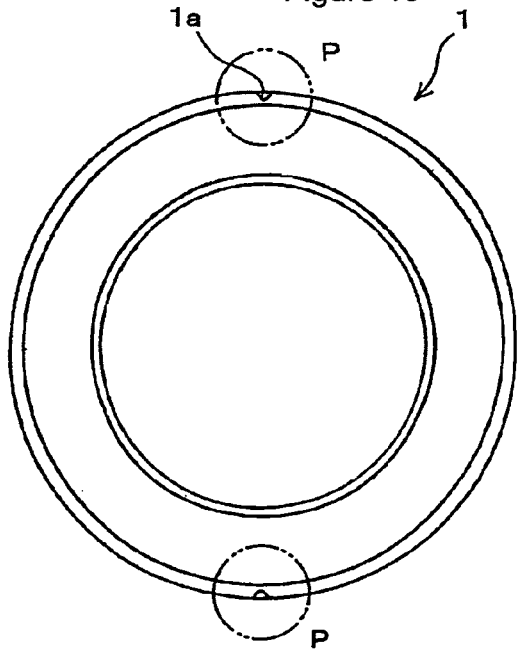
FIG. 1*c* is a front view of the cushion ring shown in FIG. 1*a*.

FIG. 1*a* is a top view showing one example of a cushion ring in accordance with the present invention, FIG. 1*b* is a side view of the cushion ring shown in FIG. 1*a*, in which the upper half thereof is sectioned, FIG. 1*c* is a front view of the cushion ring shown in FIG. 1*a*, FIG. 1*d* is an enlarged view of a portion indicated by N in FIG. 1*b*, and FIG. 1*e* is an enlarged view of a portion indicated by P in FIG. 1*c*.

The enlarged view of FIG. 1*e* is a transverse sectional view of the deepest part of a throttling groove in the portion P.

Figure 2A:
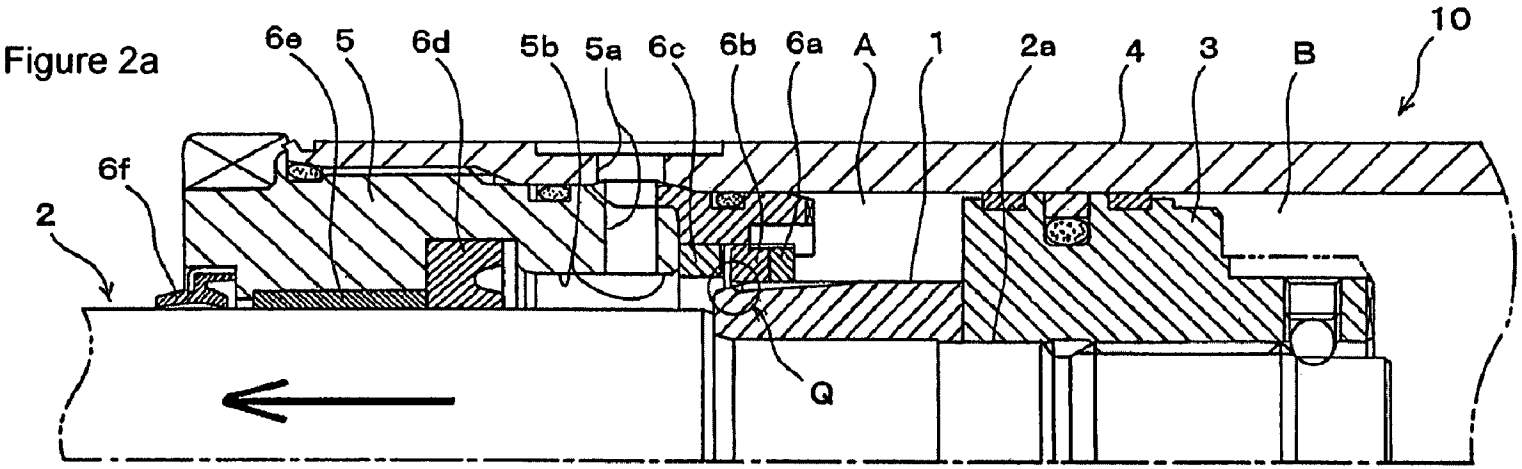
FIG. 2*a* is a longitudinal sectional view showing one example of a fluid-pressure cylinder in accordance with the present invention using the cushion ring shown in FIG. 1.
Figure 2B:
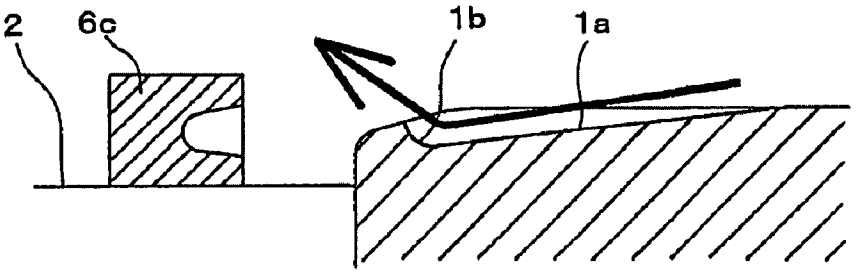
FIG. 2*b* is an enlarged view of a portion indicated by Q in FIG. 2*a*, showing the operation and effect of the cushion ring.

FIG. 2*a* is a longitudinal sectional view showing one example of a fluid-pressure cylinder in accordance with the present invention using the cushion ring shown in FIG. 1, FIG. 2*b* is an enlarged view of a portion indicated by Q in FIG. 2*a*, showing the operation and effect of the cushion ring.

A cushion ring 1 shown in FIG. 1 is used between a rod-side cylinder head and a piston rod of a fluid-pressure cylinder and is externally fitted on the piston rod to cushion a shock in the vicinity of the farthest extended end of cylinder.

The cushion ring 1 is characterized in that a throttling groove 1*a* having a V-shaped cross section, which extends from an appropriate position in the axial direction of the cushion ring 1 to a rod-side end part to throttle the flow quantity of working fluid flowing from a rod-side fluid chamber A (refer to FIG. 2*a*) to an input/output port 5*a* provided in a rod-side cylinder head 5, is provided at the outer periphery of the cushion ring 1, and an end guide face 1*b* for guiding the working fluid flowing in the throttling groove 1*a* toward the slantwise outward direction of the cushion ring 1 is provided in the rod-side end part of the throttling groove 1*a*.

A throttling groove 21*a*' in a cushion ring 21' of the related art shown in FIGS. 3*b* and 3*c* is open to the rod-side end part and ejects a working fluid flowing in the throttling groove 21*a*' to the front of the cushion ring 21' as a jet stream in the direction of the throttling groove 21*a*'.

In contrast to the throttling groove 21*a*', the end guide face 1*b* of the cushion ring 1 in accordance with the present invention is provided so as to rise in the slantwise outward direction of the cushion ring 1 with respect to the direction of the throttling groove 1*a* in such a manner as not to allow the rod-side end part of the throttling groove 1*a* to open frontward and as to obstruct the opening part.

The throttling groove 1*a* provided with the end guide face 1*b* may be provided at two locations so as to divide the outer periphery of the cushion ring 1 into two equal parts as shown in FIG. 1, may be provided at one location, or may be provided at three or more locations.

Also, the throttling groove 1*a* in this example is configured so that the V-shaped cross-sectional area increases gradually from a substantially central portion in the axial direction of the cushion ring 1 toward the rod-side end part.

By doing this, the working fluid is throttled more as the cushion ring 1 enters farther into the rod-side cylinder head 5, by which the cushioning function of the cushion ring 1 is fulfilled more satisfactorily.

Also, to meet the need for the cushioning function, the V-shaped cross-sectional area of the throttling groove 1*a* may be increased simply at a fixed ratio, or the increase ratio may be changed partially. Alternatively, a fixed cross-sectional area may be maintained from a certain portion.

For the cushion ring in accordance with the present invention, the throttling groove having a possibility of producing a jet stream of working fluid at the time of cushioning operation is not configured so that the end is open in the conventional example, but is configured so that by the end guide face, the jet stream is prevented from colliding directly with a U-ring.

Therefore, the basic feature of the cushion ring in accordance with the present invention is that the end guide face is provided in the rod-side end part of the throttling groove regardless of the change in cross-sectional area in the axial direction of the throttling groove 1*a*.

In the case where the V-shaped cross-sectional area of the throttling groove 1*a* increases gradually toward the rod-side end part as in this example, and the jet stream formed by this gradually increasing cross-sectional area goes more toward the U-ring, the end guide face achieves its effect more satisfactorily.

From the above-described point of view, regarding the shape of throttling groove, all shapes that may produce a jet stream by throttling the flow path of working fluid, including not only the V shape but also a U shape and a rectangular shape, are embraced in the scope of the present invention.

In a fluid-pressure cylinder 10 using the above-described cushion ring 1, the operation and effect of the end guide face 1*b* is explained below in more detail with reference to FIG. 2.

The fluid-pressure cylinder 10 shown in FIG. 2*a* is configured so as to generate a linear driving force by supplying a working fluid to both a bottom-side fluid chamber B and the rod-side fluid chamber A of a piston 3. The fluid-pressure cylinder 10 includes a piston rod 2 externally fitted with the cushion ring 1, the piston 3 provided in the base end part of the piston rod 2, a cylinder body 4 for sliding the piston 3 therein, and the rod-side cylinder head 5 that seals the rod side of the cylinder body 4.

On the bottom side as well, a cylinder head is provided. The explanation thereof is omitted here.

The cushion ring 1 is externally fitted in a reduced-diameter part 2*a* of the piston rod 2. To this reduced-diameter part 2*a*, the piston 3 is further fixed in an externally fitted manner. The cushion ring 1 slides together with the piston 3 and the piston rod 2 while being restrained by the piston 3.

On the inside diameter side of the rod-side cylinder head 5, a spacer 6*a*, a cushion seal 6*b*, and a collar 6*c* are internally fitted in the named order from the bottom side corresponding to the piston rod 2 and the cushion ring 1 that slide on the inside diameter side of the rod-side cylinder head 5.

The rod side from the collar 6*c* on the inside diameter side of the rod-side cylinder head 5 is a ring fitting hole part 5*b* having an inside diameter directly facing to the outside diameter of the cushion ring 1.

The aforementioned input/output port 5*a* is provided so as to penetrate the cylinder body 4 from the ring fitting hole part 5*b* to allow the working fluid to flow between the ring fitting hole part 5*b* and the outside.

On the rod side of the ring fitting hole part 5*b* of the rod-side cylinder head 5, a U-packing 6*d* that maintains fluid tightness between the piston rod 2 and the cylinder head 5, a bearing 6*e* that guides the slide of the piston rod 2, and a seal 6*f* that prevents dust from entering from the outside air are further fitted internally in the named order from the bottom side.

According to the fluid-pressure cylinder 10 configured as described above, when the piston 3 arrives at a position in the vicinity of the farthest extended end of cylinder (the state shown in FIG. 2*a*), a proper cushioning operation is performed between the throttling groove 1*a* of the cushion ring 1 and the inside diameters of the spacer 6*a*, cushion seal 6*b*, and collar 6*c*.

Subsequently, when the piston 3 advances to the rod side and the cushion ring 1 arrives at the ring fitting hole part 5*b* of the rod-side cylinder head 5, the cushion ring 1 comes close to the U-packing 6*d* on the rod side of the rod-side cylinder head 5. At this time, as shown in FIG. 2*b*, the jet stream to be ejected forward from the throttling groove 1*a* in the cushion ring 1 is guided by the end guide face 1*b*, and goes toward the inside diameter side of the ring fitting hole part 5*b*, not colliding with the end surface of the U-packing 6*d*.

Therefore, there is no fear of damage to the U-packing 6*d*.

According to the cushion ring 1 in accordance with the present invention, even in the case where the throttling groove 1*a* having a V-shaped cross section is provided, there is no fear of damage to the U-packing 6*d* on the rod side. Also, the fluid-pressure cylinder 10 using the above-described cushion ring 1 can achieve the effect of the cushion ring 1.

The cushion ring and the fluid pressure single-acting cylinder in accordance with the present invention are not limited to the above-described example. Various modifications and combinations can be made within the scope described in the claims and the scope of the example, and these modifications and combinations are embraced in the scope of right.

Also, the fluid pressure defined in this specification includes, in addition to oil pressure, a pressure produced by using any fluid other than hydraulic oil, for example, water or high molecular working fluid, as a working fluid.

The cushion ring and the fluid-pressure cylinder in accordance with the present invention can be used in industrial fields in which it is required that there be no fear of damage to the U-packing on the rod side even in the case where the throttling groove having a V-shaped cross section is provided in the cushion ring.

What is claimed is:

1. A cushion ring which is used between a rod-side cylinder head and a piston rod of a fluid-pressure cylinder and is externally fitted on the piston rod to cushion a shock in the vicinity of the farthest extended end of cylinder, wherein a throttling groove having a V-shaped cross section, which extends from an appropriate position of the cushion ring to a rod-side end part to throttle the flow quantity of working fluid flowing from a rod-side fluid chamber to an input/output port provided in a rod-side cylinder head, is provided at the outer periphery of the cushion ring, and an end guide face for guiding the working fluid flowing in the throttling groove toward the slantwise outward direction of the cushion ring is provided in the rod-side end part of the throttling groove.

2. A fluid-pressure cylinder using the cushion ring described in claim 1.

* * * * *